US005142890A

United States Patent [19]

Uyeda et al.

[11] Patent Number: 5,142,890

[45] Date of Patent: Sep. 1, 1992

[54] ELECTRO-MECHANICAL LOCK WITH ROTARY BOLT

[75] Inventors: Alan K. Uyeda, Pico Rivera; Klaus W. Gartner, Palos Verdes Estates; John Herrmann, Los Angeles; Peter J. Phillips, Long Beach, all of Calif.

[73] Assignee: La Gard, Inc., Torrance, Calif.

[21] Appl. No.: 562,200

[22] Filed: Jul. 31, 1990

Related U.S. Application Data

[63] Continuation-in-part of Ser. No. 533,893, Jun. 6, 1990.

[51] Int. Cl.[5] ..... E05B 47/00

[52] U.S. Cl. ..... 70/277; 70/279; 70/303 A

[58] Field of Search ..... 70/277-279, 70/303 A, 303 R, 333 A, 333 R, 332

[56] References Cited

U.S. PATENT DOCUMENTS

| | | | |
|---|---|---|---|
| 2,053,901 | 9/1936 | Findlay | 70/303 A |
| 2,658,374 | 11/1953 | Behrens | 70/303 A X |
| 2,823,536 | 2/1958 | Watson . | |
| 3,702,070 | 11/1972 | Gartner . | |
| 3,758,734 | 9/1973 | Gartner . | |
| 4,106,316 | 8/1978 | Tippin | 70/303 A X |
| 4,148,092 | 4/1979 | Martin . | |
| 4,220,022 | 9/1980 | Willach | 70/278 |
| 4,268,076 | 5/1981 | Itoi | 70/279 X |
| 4,457,148 | 7/1984 | Johansson et al. . | |
| 4,665,727 | 5/1987 | Uyeda . | |
| 4,669,394 | 6/1987 | Fogleman et al. | 70/278 X |
| 4,685,709 | 8/1987 | Kambic | 70/279 X |
| 4,714,030 | 12/1987 | Cole . | |
| 4,745,784 | 5/1988 | Gartner . | |
| 4,831,851 | 5/1989 | Larson | 70/277 X |
| 4,887,445 | 12/1989 | Beatty | 70/278 |
| 4,895,008 | 1/1990 | Blake | 70/277 X |
| 4,899,562 | 2/1990 | Gartner et al. . | |
| 4,904,984 | 2/1990 | Gartner et al. . | |
| 4,967,577 | 11/1990 | Gartner et al. | 70/279 |

FOREIGN PATENT DOCUMENTS

| | | | |
|---|---|---|---|
| 407305 | 9/1944 | Italy | 70/303 R |

*Primary Examiner*—Renee S. Luebke
*Assistant Examiner*—Suzanne L. Dino
*Attorney, Agent, or Firm*—Poms, Smith, Lande & Rose

[57] ABSTRACT

An electronic lock for a safe door is provided with a digital keypad entry device, a mechanical bolt works and associated handle for retracting the door bolts, and a spring biased rotary bolt which engages and precludes operation of the bolt works, such that upon entry of the predetermined code into the entry device, an electric signal causes a solenoid to energize and retract its armature from a blocking position relative the rotary bolt, further enabling the rotary bolt to rotate against its bias in response to mechanical manipulation of the handle by the user to retract the door bolts. Unauthorized operation of the safe handle causes the rotary bolt to be locked into a fixed position, preventing entry into the safe.

15 Claims, 8 Drawing Sheets

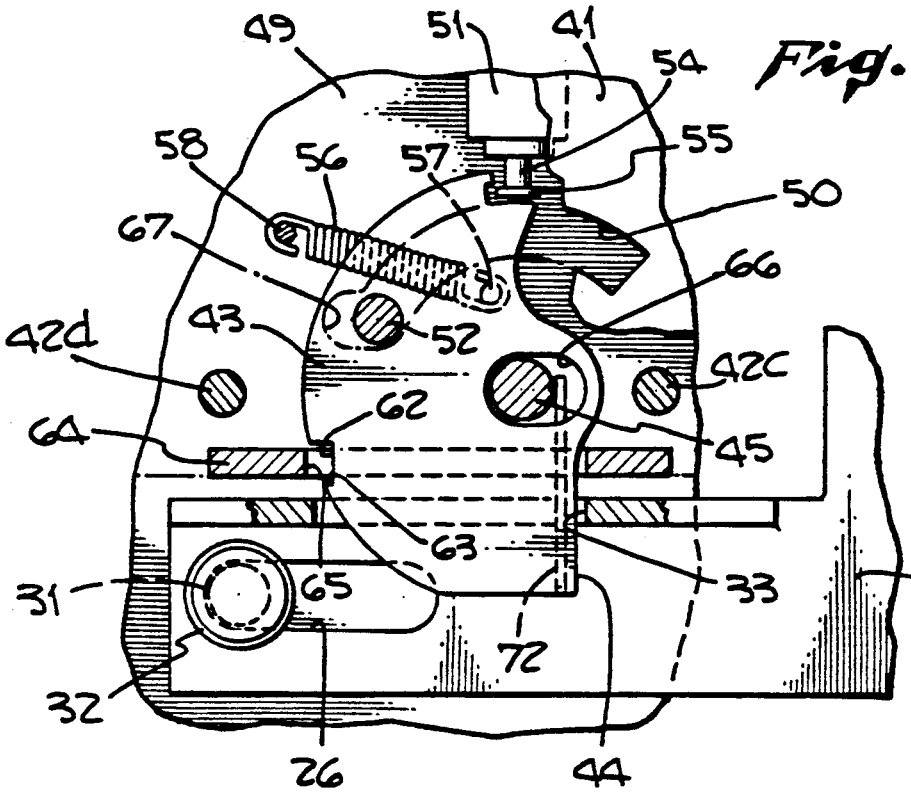
Fig. 8.
Fig. 9.
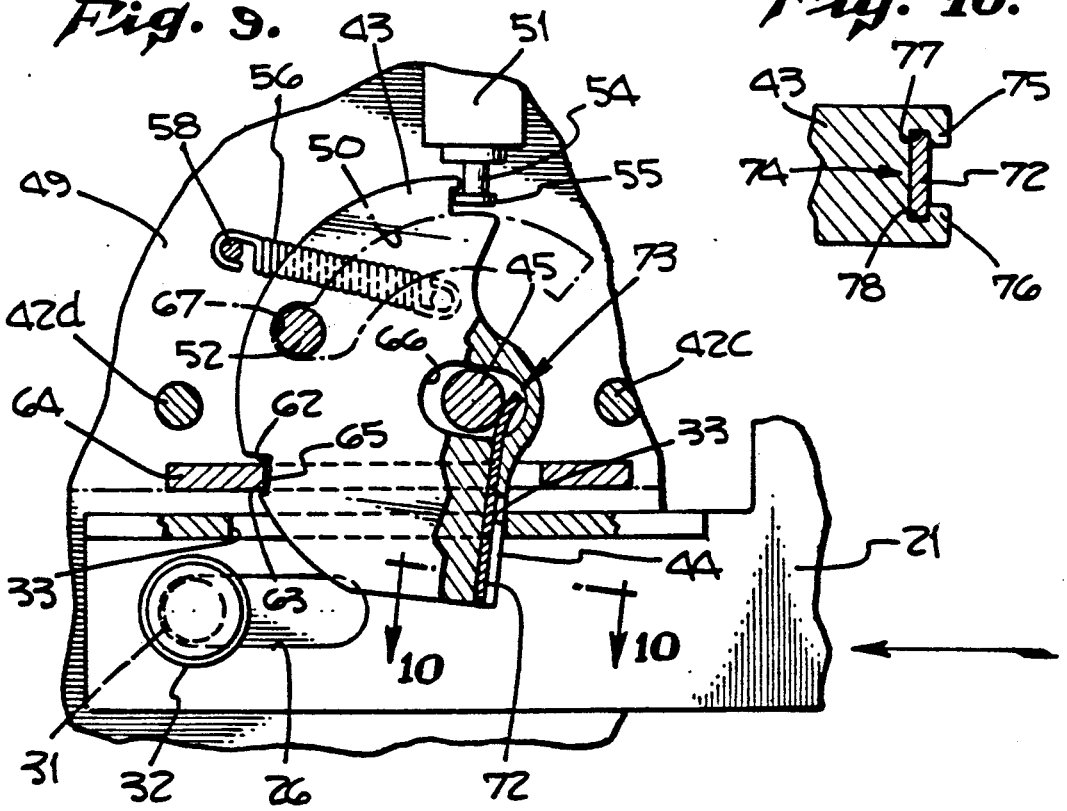
Fig. 10.

ELECTRO-MECHANICAL LOCK WITH ROTARY BOLT

RELATED APPLICATIONS

This application is a continuation-in-part application based upon applicant's copending application, Ser. No. 07/533,893, filed Jun. 6, 1990, entitled "Electro-Mechanical Lock With Rotary Bolt."

INTRODUCTION

Generally stated, the present invention relates to electrically operated locks for safe doors and the like, and more particularly to an electro-mechanical lock with a rotary bolt for use with safe doors having manually operated bolt works.

BACKGROUND OF THE INVENTION

Doors of safes, vaults, strong rooms, and like security closures (hereinafter collectively referred to as safes) are provided with at least one and preferably a plurality of bolts that are reciprocated from a non-locking position to an extended locking position. When more than one bolt is provided, a bolt works connects the bolts so that they may be simultaneously moved when a single handle is operated. A locking device is also provided to secure the bolts in their extended locking position.

An electronic locking device for such a safe is disclosed in U.S. Pat. No. 4,665,727. In this prior exemplary electronic lock mechanism, an electronically articulated linkage is provided which enables manipulation of the bolt works after entry of a predetermined combination code. However, a problem encountered with articulable linkage mechanisms is that they are susceptible to unauthorized movement due to pounding, jostling or otherwise manipulating the door handle.

A rotary bolt mechanism is much less susceptible to such unauthorized lateral movement, and therefore provides greater security to operators and users of safes. A rotary bolt mechanism for a safe is disclosed in U.S. Pat. No. 4,493,199. In this prior exemplary bolt mechanism, a rotatably mounted cam member is provided which drives the door bolts between locking and unlocking positions after manipulation of a mechanical dial lock mechanism. It is anticipated that users of safes would prefer the ease, convenience and reliability of an electronic lock with the tamper proof characteristics of a rotary bolt.

SUMMARY OF THE INVENTION

It would be desirable to be able to modify a standard safe door bolt mechanism with an electronic lock which would give increased security and convenience to such a door. It would also be desirable to be able to continue to use the preexisting bolt works and safe door opening handle provided on such safe doors.

It is therefore a primary object of the present invention to provide an electronic lock mechanism for a conventional safe door wherein the lock mechanism is assembled to such a safe door in place of the manipulative portions of the existing mechanical lock mechanism. It is also an object of the present invention to provide such an electronic lock wherein an electronic digital keypad entry device may be employed for entry of the combination. It is still further object of the present invention to provide a lock as in the foregoing objects wherein the movement of the safe door handle is restricted until after the code has been entered, the handle then being freed to be manipulated by the user to throw the safe bolt between the safe door locked protracted and door unlocked retracted positions. It is still further object of the present invention to provide a lock as in the foregoing objects wherein movement of the door bolts is precluded by the use of a rotary bolt. It is yet another object of the present invention to provide a lock as in the foregoing objects which is impervious to unauthorized manipulation, such as pounding or jostling.

Generally stated, the present invention includes the provision of an electronic code entry device, a safe door bolt manipulation means which moves the safe door bolts between protracted and retracted positions in response to rotation of a standard safe door handle, and a locking means for normally restricting operation of the bolt manipulation means until the predetermined electronic code has been entered and a code responsive signal generated. Additionally, an entry preclusion means is provided which precludes unauthorized operation of the locking means.

More specifically, the locking means of the present lock includes a spring biased rotary bolt provided with a limit stop and a cam surface, wherein the cam surface engages and restricts operation of the bolt manipulation means, and a solenoid armature post normally biased to a position where it engages the limit stop restricting rotation of the rotary cam bolt until after entry of the predetermined code, at which time the post retracts allowing rotation of the rotary bolt against its bias. More specifically, the limit stop has an over-hanging retainer lip and the post has a flange on the end whereby the post flange underlies the limit stop retainer lip to prevent unauthorized lock defeating manipulation of the post through vibration, pounding or other attempted unauthorized manipulation of the lock.

A more complete understanding of the electro-mechanical lock of the present invention will be afforded to those skilled in the art, as well as a realization of additional advantages and objects thereof, by a consideration of the following detailed description of a preferred exemplary embodiment thereof. Reference will be made to the appended sheets of drawings which will be first described briefly.

DESCRIPTION OF THE DRAWINGS

FIG. 8 is an enlarged detail view, as in FIG. 6, showing the rotary cam bolt and the exemplary unauthorized entry preclusion means;

FIG. 9 is a view as in FIG. 8 showing the preclusion means in the secured position;

FIG. 10 is a sectional view through the rotary cam bolt, as revealed by the section 10—10 taken in FIG. 9;

DETAILED DESCRIPTION OF A PREFERRED EXEMPLARY EMBODIMENT

Figure 1:
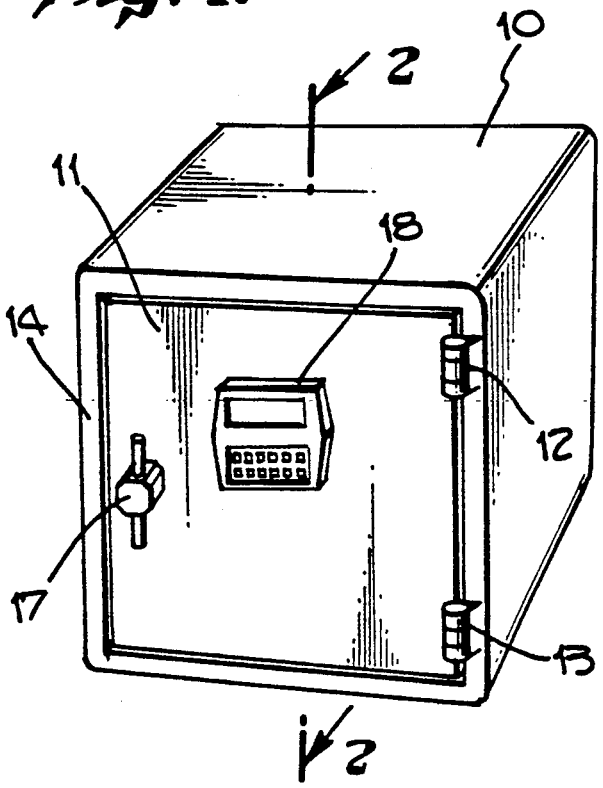
FIG. 1 is a perspective view of an exemplary safe door installation of a preferred exemplary embodiment of the electro-mechanical lock of the present invention.

Referring to FIG. 1, a preferred exemplary embodiment of an electro-mechanical lock for a safe door in accordance with the present invention is illustrated in association with a safe 10 having an otherwise standard door 11 attached by hinges 12 and 13, and having handle 17 to operate the bolt works mechanism, as hereinafter described. An electronic code entry device 18 having an internal circuit board is mounted on the front of the door 11 and is used for entering the combination code and generating an electrical signal, as will also be described hereinafter.

Figure 2:
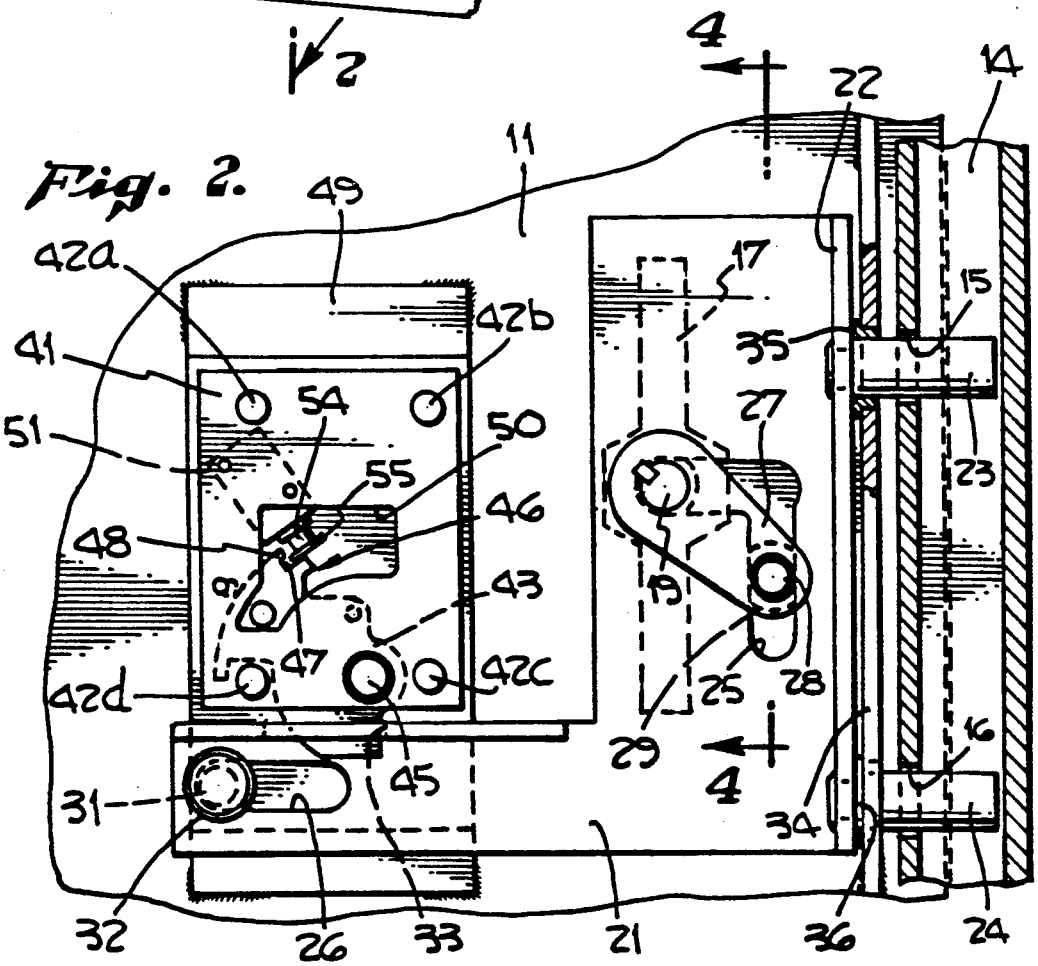
FIG. 2 is a partial view of the interior of the exemplary safe door showing the electro-mechanical lock mechanism in the bolt protracted position, as revealed by the section 2—2 taken in FIG. 1.
Figure 4:
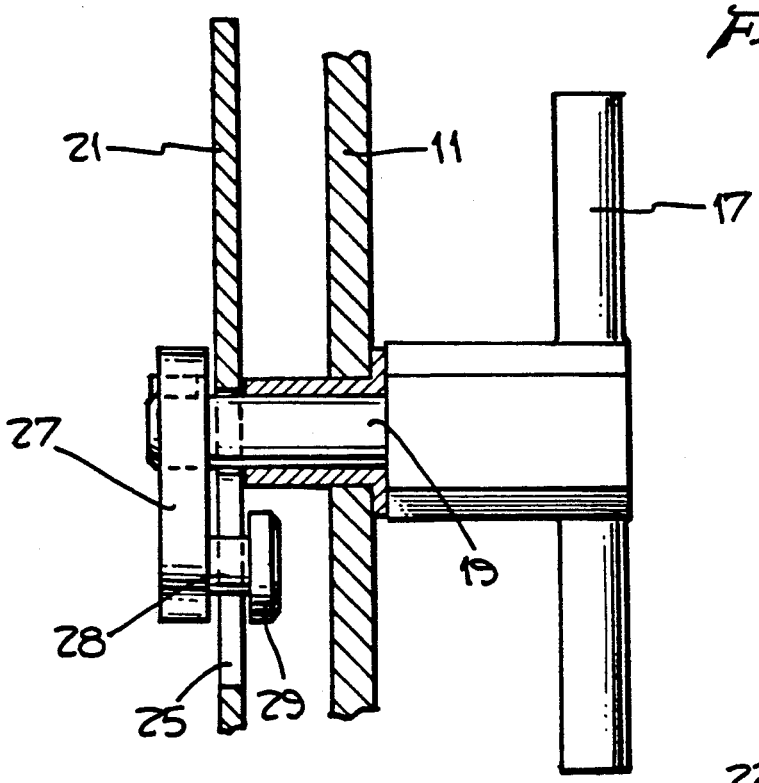
FIG. 4 is a sectional view of the exemplary bolt manipulation means, as revealed by the section 4—4 taken in FIG. 2.

As seen in FIG. 2, the interior of safe door 11 has an edge flange 34 and a locking means mounting plate 49, to which is mounted the exemplary locking means, as will be hereinafter described. Mechanically attached to the interior of door 11 is a laterally movable retraction plate 21. The retraction plate 21 is generally L-shaped, and has a right angled mounting flange 22. The exemplary safe door has two bolts 23 and 24 which are attached to mounting flange 22 and pass through linear bearings 35 and 36, integral to edge flange 34. Door bolts 23 and 24 are relatively positioned to engage bolt receptacles 15 and 16 in safe door jamb 14. Handle 17 is assembled to shaft 19, which penetrates the door 11 and attaches to retraction arm 27 such that operation of handle 17 in a rotary manner causes direct rotation of retraction arm 27.

Retraction plate 21 has a pair of guide paths 25 and 26 cut into its surface, in which retraction pins 28 and 31 travel, and a cam lock aperture 33, as will be hereinafter described. Upper retraction pin 28 is fixed to retraction arm 27, and lower retraction pin 31 is fixed to the interior of safe door 11, such that rotation of door handle 17 causes upper retraction pin 28 to move through an arc within guide path 25 and exert a lateral force on retraction plate 21, further causing lateral motion of retraction plate 21 parallel to door 11 along guide paths 25 and 26. To prevent skewing of retraction plate 21 during its lateral motion, guide wheels 29 and 32 are provided. Guide wheel 29 mounts on the end of upper retraction pin 28, and guide wheel 32 mounts on the end of lower retraction pin 31. In the preferred embodiment, a clockwise rotation of door handle 17, as viewed from the front of the safe 10 per FIG. 1, causes lateral movement of retraction plate 21 in a protracting direction further causing bolts 23 and 24 to protract relative door 11 through linear bearings 35 and 36, and into receptacles 15 and 16, into the door locked position. Likewise, a counterclockwise rotation of door handle 17 results in retraction of bolts 23 and 24 from receptacles 15 and 16, into the door unlocked position. However, lateral movement of retraction plate 21 as described hereinbefore is normally prevented by the use of a locking means.

Figure 7:
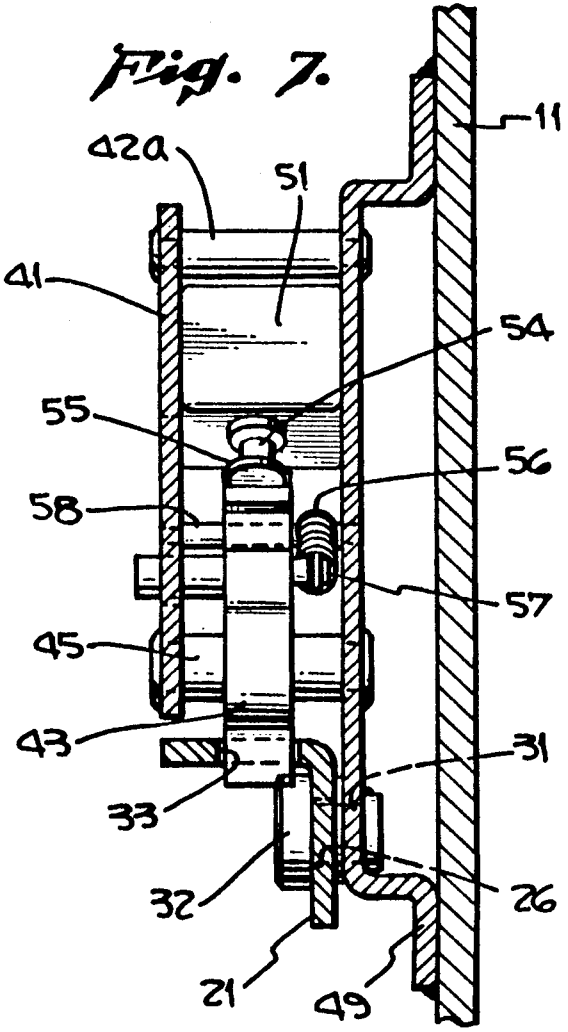
FIG. 7 is a sectional view through the locking means, as revealed by the section 7—7 taken in FIG. 6.

Referring now to FIG. 7, the exemplary locking means is mechanically attached to mounting plate 49, and includes the provision of a rotary bolt 43, an axle shaft 45 and an electrically operable solenoid 51. Rotary bolt 43 is generally semicircular in shape, and having a center bore 38, a cam surface 44 and a limit stop, indicated generally at 46. Axle shaft 45 is rigidly attached to mounting plate 49, and rotatably attaches to bore 38 of rotary bolt 43 such that rotary bolt rotates through a plane parallel to door 11. Solenoid 51 is secured to mounting plate 49 by bolts 53*a* and 53*b*. Cover plate 41 is also provided, which attaches to mounting plate 49 by means of four spacer pins $42_a$, $42_b$, $42_c$, $42_d$, and which blocks access to the locking means. Arcuate slot 50 is placed in cover plate 41, which exposes a portion of rotary bolt 43 and solenoid 51, as best shown in FIG. 2. Limit pin 52 is attached to rotary bolt 43, and travels in arcuate slot 50 as the rotary bolt rotates and which limits the arcuate travel of rotary bolt in both directions.

Figure 6:
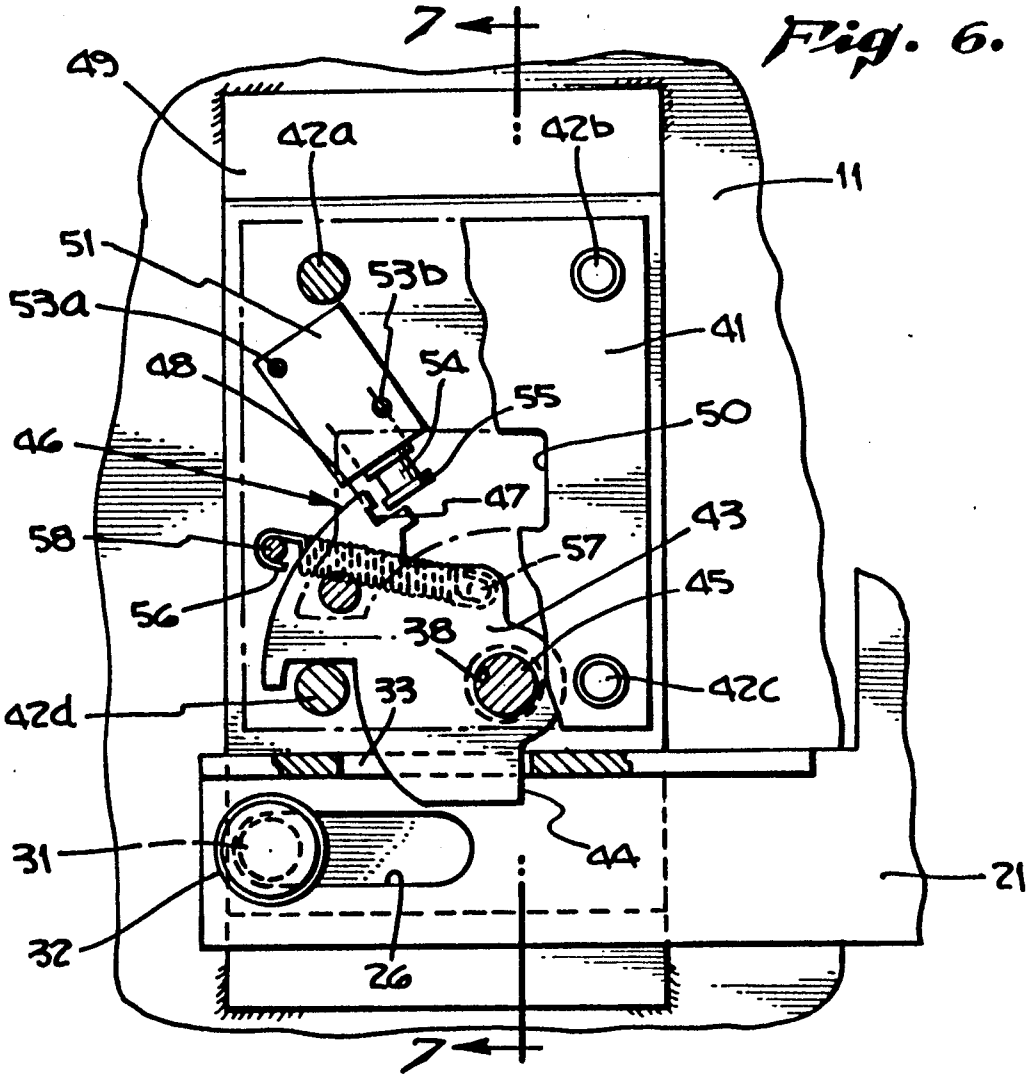
FIG. 6 is an enlarged detail view, similar to FIG. 2, showing the rotary cam bolt in the biased position.

The exemplary rotary bolt 43 normally engages lock aperture 33 on retraction plate 21, as illustrated in FIGS. 2, 6 and 7, such that lateral movement of retraction plate 21 is impeded. Rotary bolt 43 is normally biased into the first locking position relative lock aperture 33 by use of biasing spring 56, which attaches to rotary bolt at a first spring retaining pin 57 and to mounting plate 49 at a second spring retaining pin 58.

In the preferred exemplary embodiment, cam surface 44 of rotary bolt 43 contacts the trailing edge of lock aperture 33 such that lateral movement of retraction plate 21 as caused by manipulation of handle 17 further causes rotary bolt 43 to rotate clockwise, as viewed from the interior of safe 10 per FIG. 2, against its spring bias to a second unlocked position in which rotary bolt 43 has fully moved out of the locking position relative retraction plate 21. During prolonged periods in which the door 11 remains open, the rotary bolt 43 will remain in the second position against its bias due to contact between retraction plate 21 and cam surface 44, until the user returns the door handle 17 to the door locked position, protracting bolts 23 and 24, upon which cam surface 44 will re-engage aperture 33 and rotary bolt 43 rotates back to its normally biased position.

Figure 5:
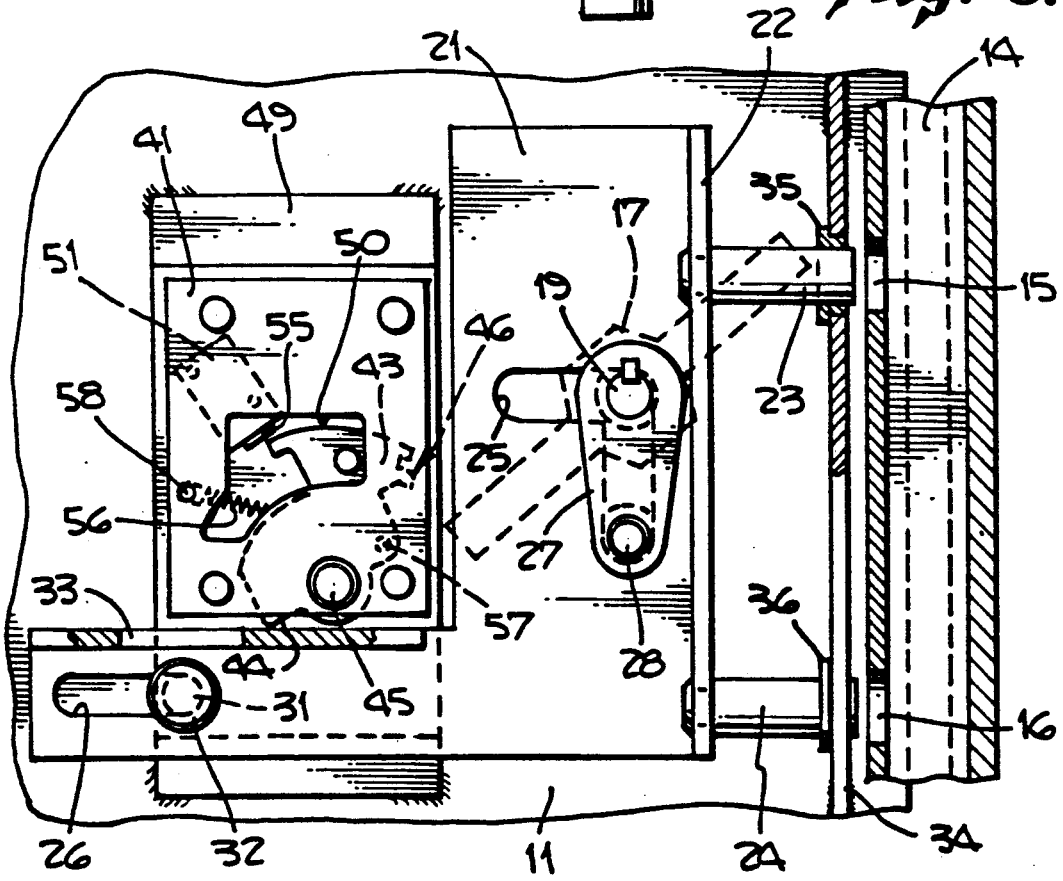
FIG. 5 is a view as in FIG. 2 showing the electro-mechanical lock mechanism in the bolt retracted position.

The exemplary locking means also includes the provision of post 54, and a limit stop, indicated generally at 46 as shown in FIGS. 2, 5 and 6. Post 54 comprises a portion of the armature of an electrically operable solenoid 51 also fixed to mounting plate 49. The exemplary limit stop comprises limit stop surface 47 and an overhanging retainer lip 48, both integral to rotary cam bolt 43. Post 54 is positioned as seen in FIGS. 2 and 6, such that post retainer flange 55 normally engages the exemplary limit stop, thus preventing rotation of rotary bolt 43, and thus further preventing lateral movement of retraction plate 21. The provision of the retainer lip 48 is important to prevent unauthorized rotation of rotary bolt 43 as might otherwise occur if the post 54 could be urged inwardly of solenoid 51 against the outward bias of an internal spring provided, through vibration, tapping or other unauthorized manipulation of the lock mechanism.

Figure 3:
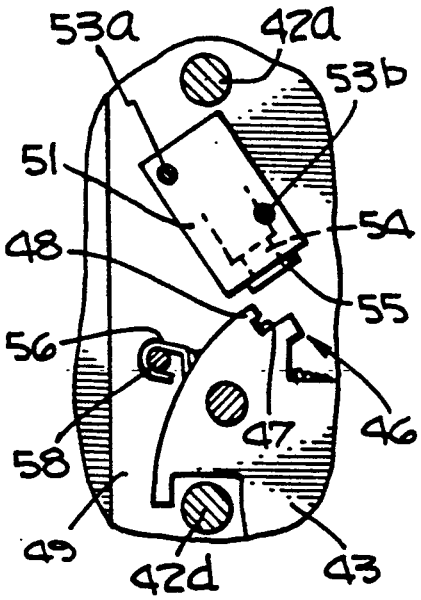
FIG. 3 is a partial view of the exemplary locking means with the solenoid in the armature retracted position.

As is particularly contemplated within the present invention, the manual entry of a coded sequence into combination code entry device 18 causes the generation of an electrical signal, such as a voltage, as known in the art. The electrical signal is transferred by known electrical means to solenoid 51, which energizes and retracts post 54 inwardly against its internal spring bias, as shown in FIG. 3, disengaging the exemplary locking means. The user is then free to manipulate door handle 17, causing movement of retraction plate 21, which further causes rotary bolt 43 to rotate against its spring bias unimpeded by post 54, bringing cam surface 44 out of contact with aperture 33 and eventually allowing the full retraction of bolts 23 and 24 to the door unlocked position as shown in FIG. 5.

Also contemplated within the present invention is the use of an exemplary entry preclusion means to prevent unauthorized entry of the safe. As illustrated in FIGS. 8 and 9, the entry preclusion means includes the provision of a safety notch 62, a safety key 64, an elongated bore 66 and a leaf spring 72. Safety notch 62 is integral to the periphery of rotary bolt 43, and is positioned relative safety key 64, which is fixably attached to mounting plate 49 to lockingly engage the key 64 on forceable manipulation of handle 17 as subsequently described. Elongated bore 66 is provided in the center of rotary bolt 43, and which mates with axle shaft 45. Elongated bore 66 is elliptical in shape, with its major axis running parallel to the direction of lateral travel of the retraction plate 21, such that rotary bolt 43 can be laterally as well as rotatably manipulated. Additionally, arcuate slot 50 is provided with a semi-circular extension 67, as shown in FIG. 8, also parallel in direction to the major axis of elongated bore 66.

Rotary bolt 43 is also exemplarily provided with a slot, indicated generally at 74 as shown in FIG. 10. Slot 74 is recessed within rotary bolt 43 and positioned adjacent to cam surface 44, and is sized to accept leaf spring 72. Trailing portions 75 and 76 and lateral surfaces 77 and 78 rigidly hold leaf spring 72 within slot 74, and trailing portions 75 and 76 also provide the cam surface 44. Leaf spring 72 protrudes into the elongated bore 66 where it tangentially contacts axle shaft 45. With leaf spring 72 in its normally biased position, rotary bolt 43 is in the normally operable position, as previously described hereinabove.

Unauthorized operation of door handle 17 causes retraction plate 21 to apply a lateral force on cam surface 33. Rotary bolt 43 is impeded from rotating due to contact with post 54, therefore, the lateral force causes a lateral shift of the rotary bolt. Axle shaft 45 moves within elongated bore 66, deflecting leaf spring 72, shown generally at 73 in FIG. 9. Safety notch 62 maneuvers into engagement with safety key 64, and limit pin 52 enters semicircular slot extension 67 of arcuate slot 50. With rotary bolt 43 laterally shifted such that safety key 64 has fully engaged safety notch 62, the rotary bolt is secured from any further rotation, precluding additional manipulation of retraction plate 21 by the unauthorized user. As can be seen in FIG. 9, continued unauthorized force causes lower edge 63 of safety notch 62 to press against surface 65 of safety key 64, keeping safe 10 effectively locked. Once the unauthorized operation has ceased, the rotary bolt 43 returns to its normally operable position, as shown in FIG. 8, wherein normal operation as described hereinbefore can take place.

Figure 11:
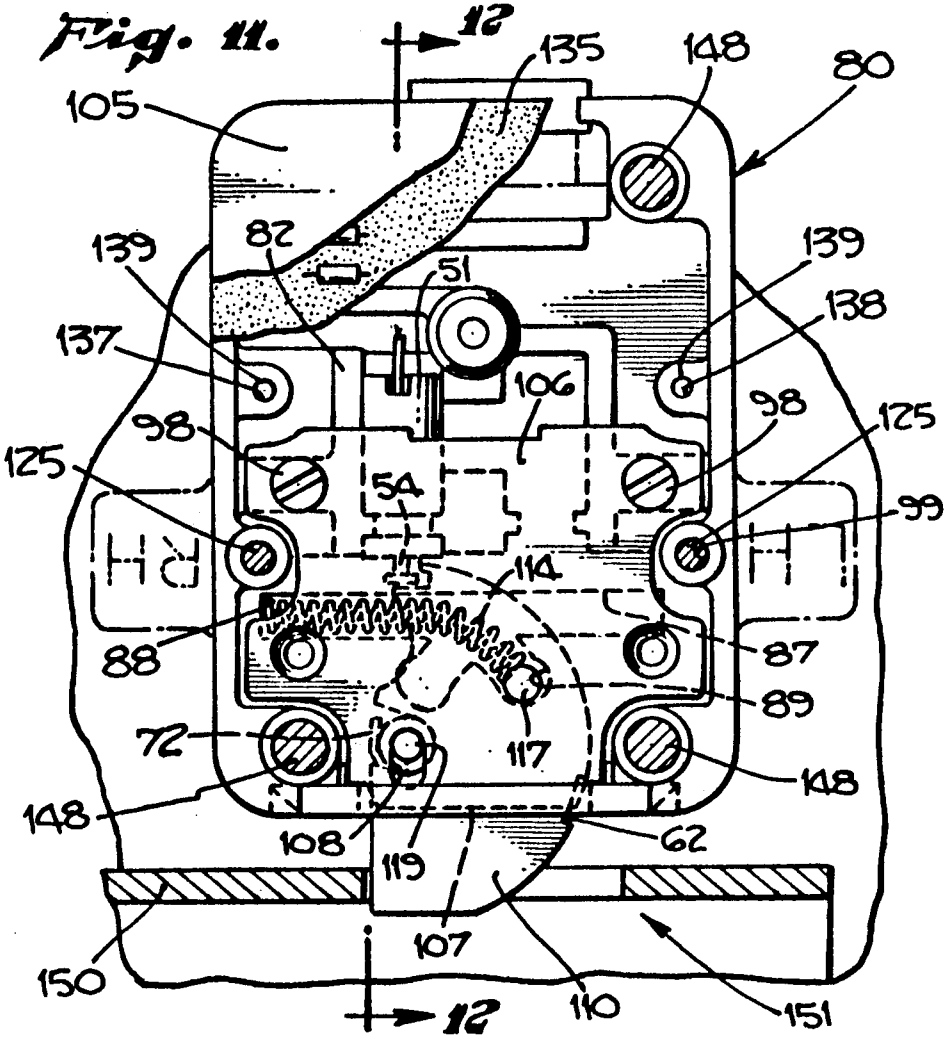
FIG. 11 is a cutaway view of an alternative rotary cam bolt lock within an enclosed housing.
Figure 18:
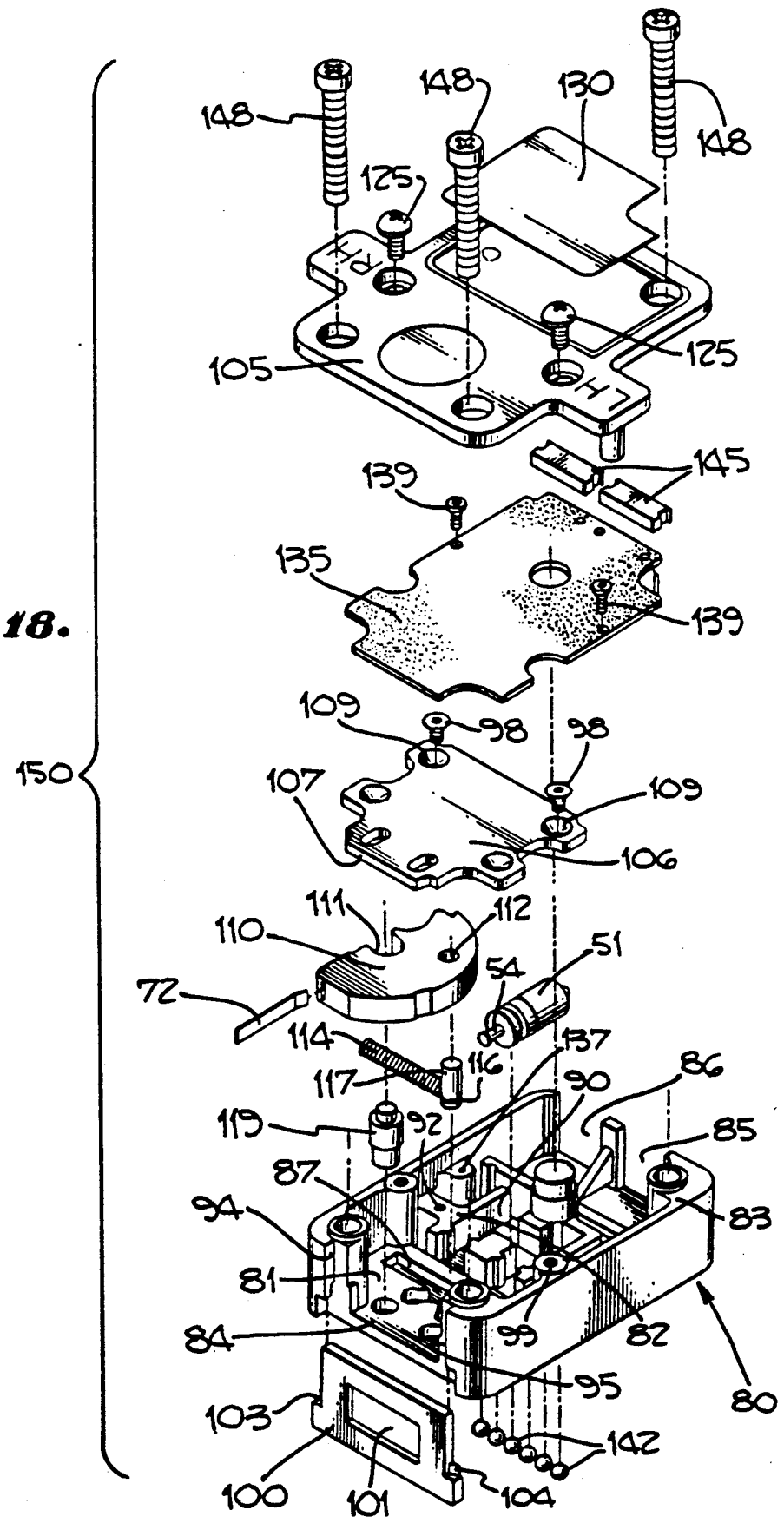
FIG. 18 is an exploded view of the alternative rotary cam bolt lock.

Referring now to FIGS. 11 through 18, the present invention can be adapted for alternative uses by putting the electro-mechanical rotary lock, shown generally at 150 of FIG. 18, within an enclosed housing. Such an enclosed lock can then be readily adapted for use in a variety of safes, security doors and like closures. FIG. 11 shows an exemplary alternative rotary lock enclosed within housing 80 having top cover 105. Top cover 105 attaches to housing 80 by the use of a plurality of mounting screws 125 which enter threaded holes 99 integral to the housing. It is anticipated that the exposed portion of top cover have a designated space to affix an identification label or other decorative marking, as exemplarily shown as 130 in FIG. 18.

Housing 80 is a generally rectangular box, and is exemplarily machined from a single block of aluminum or equivalent material. FIG. 18 shows the exemplary housing 80, which has first machined level 81, second machined level 82, third machined level 83, square first opening 84 and a plurality of second openings 85 and 86. First machined level 81 features an arcuate first recess 87 having a first and second end, 88 and 89 respectively, and has circular bore 113. Second machined level 82 has a generally rectangular second recess 90 with opposed flange portions 91*a* and 91*b*, and a plurality of mounting screw holes 92. Third machined level 83 also features a plurality of mounting screw holes 99, to which top cover 105 attaches by means of mounting screws 125, as described hereinabove. The square first opening 84 is positioned on an end of the housing, and has a first and a second edge, 94 and 95 respectively, each having internally angled wall portions, 96 and 97, respectively. Bolt plate 100 engages first opening 84, enclosing the sides of housing 80, as will be described hereinbelow. Bolt plate 100 provides rectangular bolt passage 101, as will also be described hereinbelow. It is also anticipated that housing 80 be constructed having mirror-image counterparts to the aforementioned internal features, so that the rotary bolt may be assembled, as will be hereinbelow described, in either a left-hand or right-hand configuration.

The exemplary rotary lock also comprises a generally D-shaped rotary bolt 110, having center orifice 111 and off-center orifice 112. Pivot pin 119 is provided, which engages circular bore 113 of housing 80 and center orifice 111 of rotary bolt 110, enabling the rotary bolt to rotate between a protracted and retracted position relative bolt plate 100. Rotary bolt 110 is normally biased into a position protracting through bolt passage 101, by the use of coiled spring 114. Coiled spring 114 has first flat end 115 and a second looped end 116, and inserts lengthwise into the first arcuate recess 87 with the flat end 115 abutting the first end 88 of arcuate recess 87. Spring pin 117 is provided for connecting coiled spring 114 to rotary bolt 110, the spring pin having a generally cylindrical body and knob end 118. Looped end 116 of coiled spring 114 attaches to knob end 118 of spring pin 117, and the cylindrical body portion of the spring pin inserts lengthwise into off-center orifice 112 of rotary bolt 110, with knob end 118 depending into arcuate recess 87. With rotary bolt 110 in the protracted position, knob end 118 of spring pin 117 abuts second end 89 of arcuate recess 87, providing a rotation stop to rotary bolt 110, as shown in FIG. 11.

Figure 12:
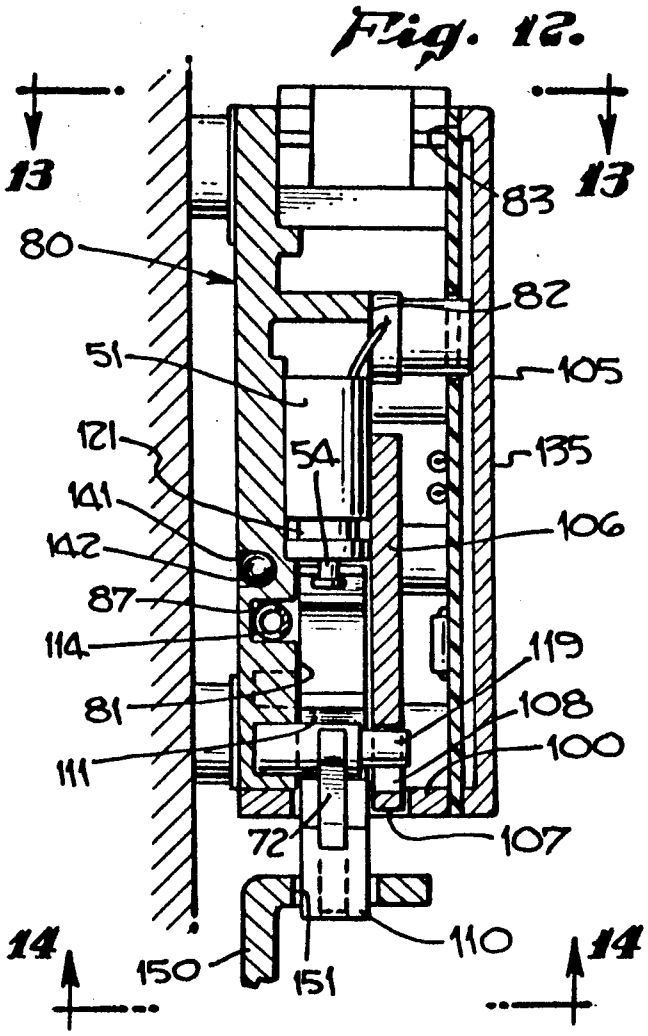
FIG. 12 is a sectional view of the alternative rotary cam bolt lock, as revealed by the section 12—12 taken in FIG. 11.
Figure 15:
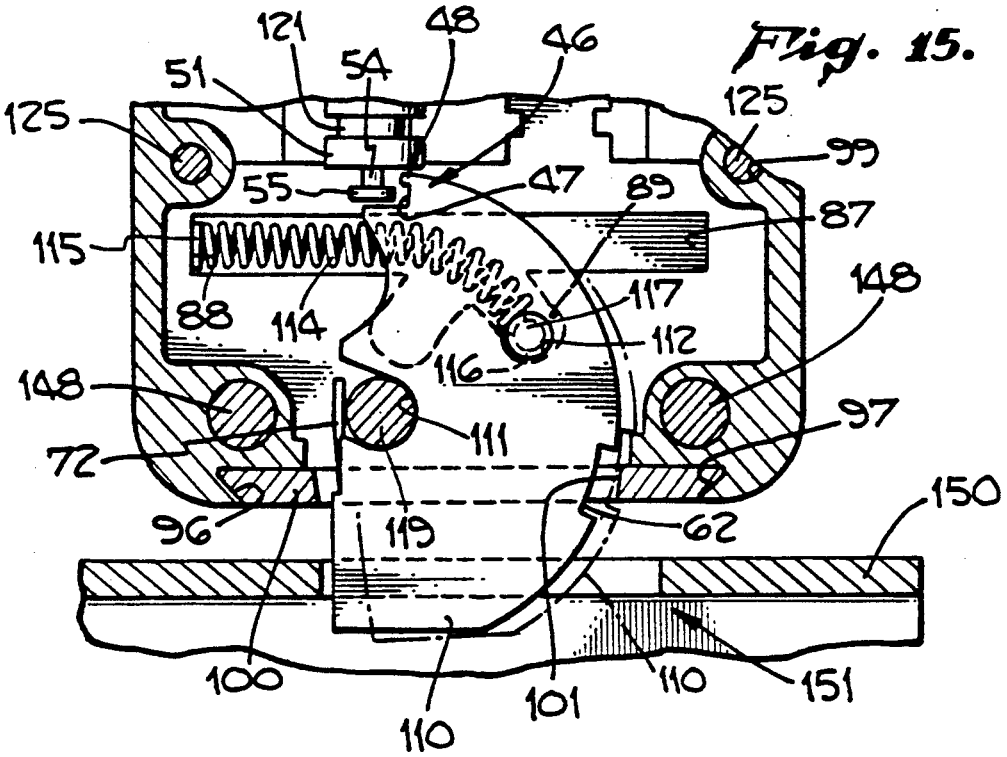
FIG. 15 is an enlarged cutaway view of the alternative rotary cam bolt lock, showing the preclusion means in the secured position.

FIGS. 11, 12 and 15 show the exemplary rotary bolt 110 in the protracted position engaging an exemplary gate 151 of bolt works 150. The exemplary bolt works 150 operates by moving laterally. With rotary bolt 110 in engagement with gate 151, lateral movement of bolt works 150 is precluded.

By exerting a pressure on the protracted end of rotary bolt 110, such as by lateral movement of bolt works 150, the bolt would rotate against the bias of coiled spring 114 upon the axis formed by pivot pin 119, retracting rotary bolt 110 into housing 80. However, a locking means is provided for normally restricting rotation of rotary bolt 110, as substantially described hereinabove. Limit stop surface 47 is provided on the retracted end of the rotary bolt 110, along with an over-hanging retainer lip 48. The locking means comprises a post 54 normally positioned to engage limit stop surface 47 and block rotation of rotary bolt 110, the post 54 having retainer flange 55 whereby when the post engages limit stop surface 47, post 54 is retained by the retainer lip 48. In the alternative locking means, solenoid 51 is provided, having a body and an armature portion normally biased outwardly of the body, with the armature providing post 54. Solenoid 51 is cylindrical shaped with a circumferential groove 121, and inserts into rectangular second recess 90, with opposed flange portions 91*a* and 91*b* entering groove 121 to rigidly engage solenoid 51.

The exemplary bolt plate 100 is slidably attached onto first opening 84 with rotary bolt 110 protruding through bolt passage 101, forming a narrow gap between upper surface of rotary bolt 110 and upper edge of bolt passage 101. Bolt plate 100 has externally angled wall portions 103 and 104 which frictionally mesh with internally angled wall portions 96 and 97 of first opening 84. Rotary bolt 110 and solenoid 51 are enclosed below the second machined level 82 by use of top plate 106. Top plate 106 has protruding edge 107, corresponding bore 108 and a plurality of mounting holes 109 along its periphery, and is inserted onto second machined level 82 with the top of pivot pin 119 entering corresponding bore 108 and protruding edge 107 extending through the narrow gap formed in bolt passage 101. The presence of protruding edge 107 between rotary bolt 110 and upper edge of bolt plate 100 maintains an enclosing pressure on bolt plate 100, forcing internally angled wall portions 96 and 97, and externally angled wall portions 103 and 104, together. Top plate 106 is fixed in place by the use of mounting screws 98 which insert into mounting holes 92 of second machined level 82.

Figure 13:
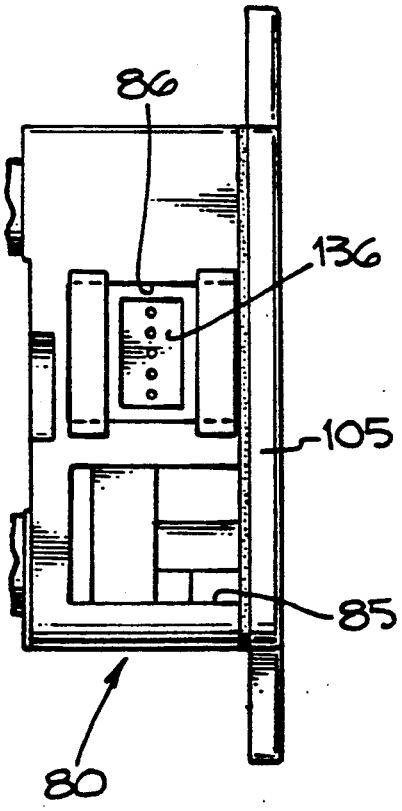
FIG. 13 is an end view of the alternative rotary cam bolt lock, as revealed by the section 13—13 taken in FIG. 12.
Figure 14:
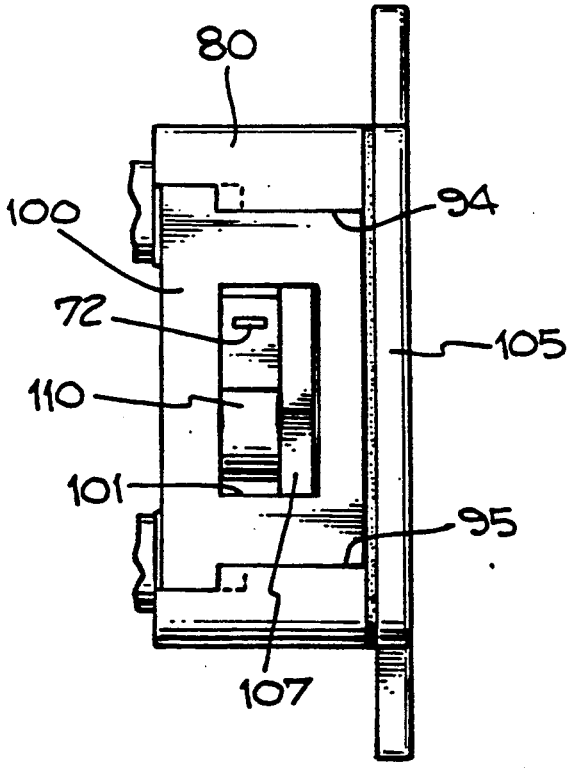
FIG. 14 is a second end view of the alternative rotary cam bolt lock, as revealed by the section 14—14 taken in FIG. 12.

Once top plate 106 has been secured in place, internal circuit board 135 is installed within housing 80. Circuit board 135, shown in FIGS. 11, 12 and 18, connects electrically to solenoid 51, and provides an electrical signal to retract the armature of solenoid 51 to disengage the locking means. An external connector 136 is also provided, such as a telephone-type connector that is commonly used in the industry, and connects electrically with circuit board 135, and can be attached in either of second openings 85 or 86. FIG. 13 shows an exemplary external connector inserted into second opening 86. Spacers 145 may be used to facilitate installation of external connector 136. The external connector 136 electrically receives the signals generated by combination code entry device 18, as described hereinabove.

A pair of circuit board mounting holes 137 and 138 are provided on opposite sides of housing 80, on protruding portions intermediate second machined level 82 and third machined level 83. Circuit board 135 attaches to housing 80 by use of mounting screws 139 which enter mounting holes 137 and 138. Upon securing circuit board 135 in place, top cover 105 can be attached to housing 80, as described hereinabove.

Operation of the alternative electro-mechanical lock is substantially similar to the operation of the exemplary rotary lock described hereinabove. Upon manual entry of a predetermined combination code into code entry device 18, as shown in FIG. 1, circuit board 135 generates an enabling signal to solenoid 51, causing the locking means to disengage. The rotary bolt 110 can then be rotated from the protracted to the retracted position, shown in FIG. 17, further enabling boltworks 150 to shift laterally.

It is also anticipated within the alternative embodiment of the rotary lock, that an entry preclusion means be used to prevent unauthorized manipulation of rotary bolt 110. As illustrated in FIG. 15, the entry preclusion means of the alternative rotary lock is substantially similar to that described hereinabove, and includes the provision of safety notch 62 and leaf spring 72. Rotary bolt 110 is provided with slot 74, as shown in FIG. 10, in which leaf spring 72 is inserted. Center orifice 111, as described hereinabove, is elongated in shape, and leaf spring 72 protrudes into center orifice, tangentially contacting pivot pin 119. With leaf spring 72 normally biased, rotary bolt 110 is in the normally operable position, as shown by the solid lines in FIG. 15.

Unauthorized force applied to the rotary bolt 110, while the locking means is in the position blocking rotation of rotary bolt 110, causes lateral shift of the rotary bolt 110. Pivot pin 119 moves within center orifice 111, deflecting leaf spring 72. Safety notch 62 maneuvers into engagement with side surface of bolt plate 100, as shown by the phantom lines of FIG. 15. In the phantom position of FIG. 15, further rotation of the rotary bolt 110 is precluded.

Figure 16:
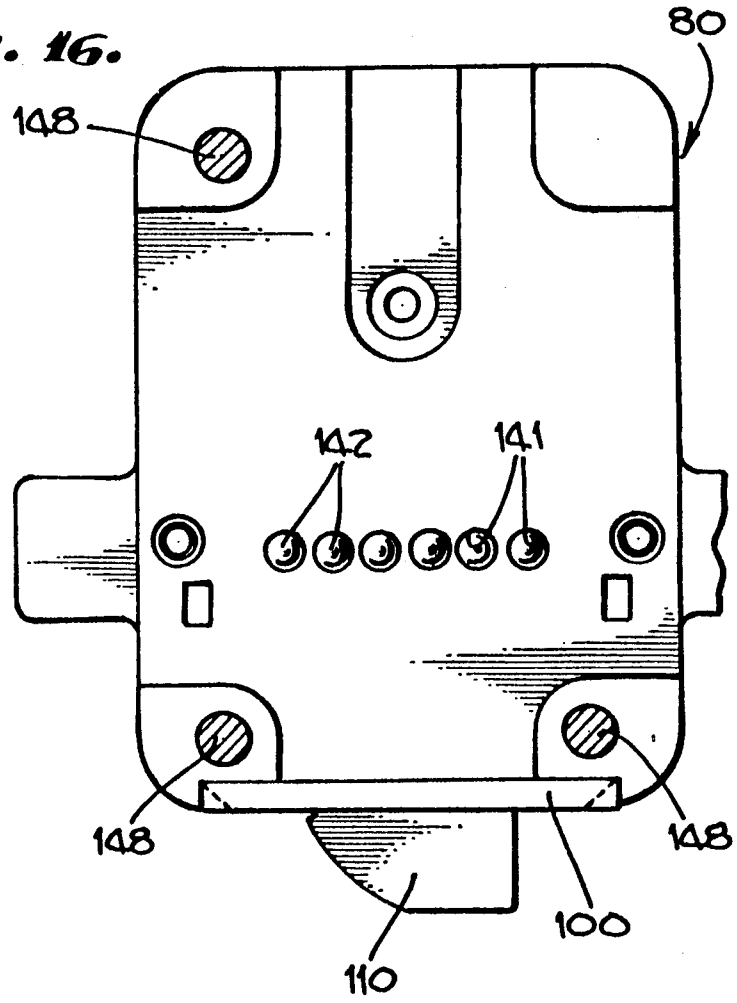
FIG. 16 is a rear view of an alternative rotary cam bolt lock.
Figure 17:
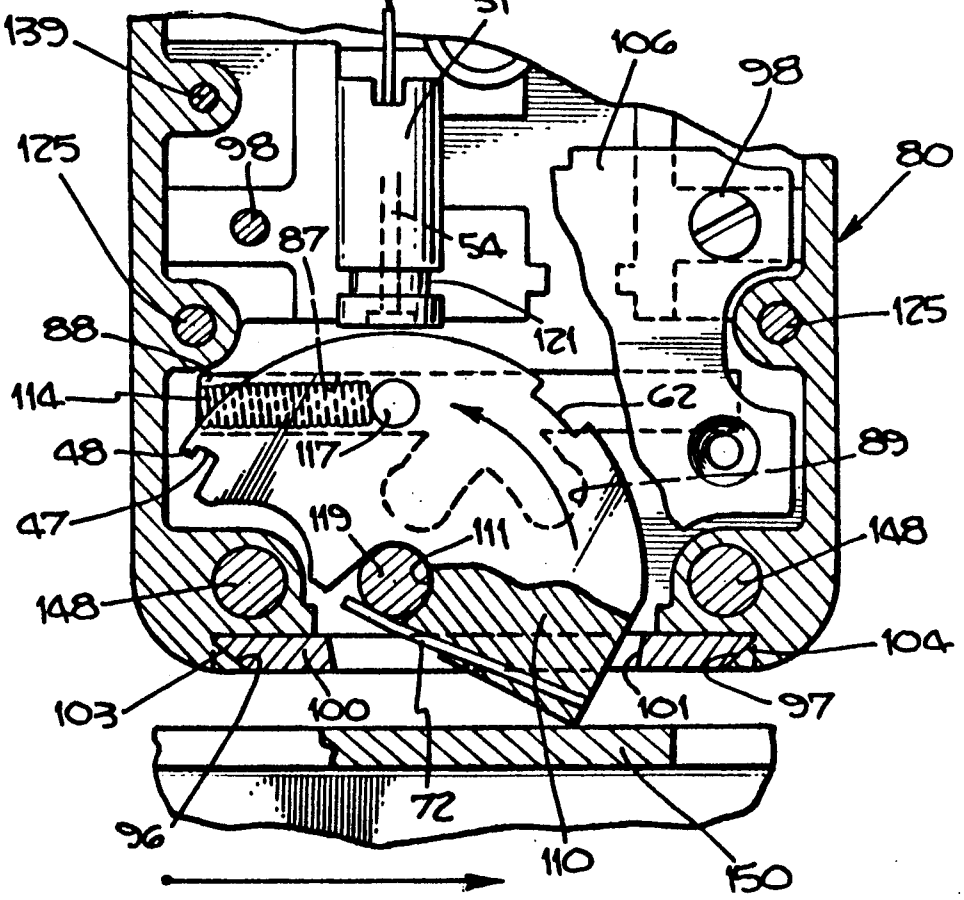
FIG. 17 is an enlarged cutaway view of the alternative rotary cam bolt lock, showing the rotary bolt in the retracted position.

It is also anticipated that the exemplary housing 80 be provided with a plurality of metallic balls 142, each of which being inserted into an individual one of a plurality of holes 141, as shown in FIG. 16. The holes, with the metallic balls inserted, linearly traverse the exterior of the housing, corresponding to the internal location of post 54. The balls provide reinforcement to post 54, preventing unauthorized penetration of the housing, such as by drilling.

Having thus described a preferred exemplary embodiment of an electro-mechanical safe door lock in accordance with the present invention, it should now be apparent to those skilled in the art that the aforestated objects and advantages for the within lock have been achieved. It should also be appreciated by those skilled in the art that various modifications, adaptations and alternative embodiments thereof may be made within the scope and spirit of the present invention which is defined by the following claims.

We claim:

1. An electro-mechanical rotary lock, comprising:

a housing, a bolt plate and a cover associated with said housing, said housing having a first opening, said bolt plate engaging said first opening, and providing a bolt passage;

a spring-biased rotary bolt which is rotatable between a protracted and a retracted position relative said bolt plate, said rotary bolt being generally D-shaped, and having a first and a second end, said rotary bolt extending outwardly relative said housing through said bolt passage when in said protracted position;

a locking means for normally restricting rotation of said rotary bolt;

an electronic combination entry device for manual entry for a coded sequence and an associated electrically-operated means for producing a code responsive signal to disengage said locking means; and an entry preclusion means for restricting rotation of said rotary bolt in response to unauthorized forcing of said rotary bolt.

2. The electro-mechanical rotary lock of claim 1, wherein:

said first end normally protrudes through said bolt passage and has a cam surface, and said second end has a rotation limit stop having an associated overhanging retainer lip;

said locking means comprises a post normally positioned to engage said limit stop and block rotation of said rotary bolt, said post having a retainer flange whereby when said post engages said limit stop, said post flange is retained by said retainer lip.

3. The electro-mechanical rotary lock of claim 2, wherein:

said electrically operated means comprises a solenoid having a body and an armature portion normally biased outwardly of said body, and a circuit board for generating a code responsive signal upon entry of said coded sequence which retracts said armature; and said circuit board is internal to said housing, and said armature provides said post.

4. An electro-mechanical rotary lock, comprising:

a housing, a bolt plate and a cover associated with said housing, said housing having a first opening, said bolt plate engaging said first opening and providing a bolt passage;

a spring biased rotary bolt which is rotatable between a protracted and a retracted position relative said bolt plate, said rotary bolt being generally D-shaped and having a first and a second end; said first end normally protrudes through said bolt passage and has a cam surface, and said second end has a rotation limit stop having an associated overhanging retainer lip;

a locking means for normally restricting rotation of said rotary bolt; said locking means comprising a post normally positioned to engage said limit stop and block rotation of said rotary bolt, said post having a retainer flange whereby when said post engages said limit stop, said post flange is retained by said retainer lip;

an electronic combination entry device for manual entry of a coded sequence and an associated electrically operated means for producing a code responsive signal to disengage said locking means; said electrically operated means comprising a solenoid having a body and an armature portion normally biased outwardly of said body, and a circuit board for generating a code responsive signal upon entry of said coded sequence which retracts said armature; said circuit board is internal to said housing, and said armature provides said post; and an entry preclusion means for restricting rotation of said rotary bolt in response to unauthorized forcing of said rotary bolt, wherein:

said entry preclusion means comprises a safety notch, an engaging surface, a leaf spring and an elongated bore, said safety notch being integral to the periphery of said rotary bolt between said first end and said second end and disposed relative to be engaged by said engaging surface, said bolt plate providing said engaging surface, said elongated bore extending through the center of said rotary bolt and enabling said rotary bolt to shift laterally between a normally operable position and a secured position with said leaf spring normally biasing said rotary bolt into said operable position, said rotary bolt further having a recessed slot and said leaf spring engaging said recessed slot such that a portion of said leaf spring protrudes into said elongated bore;

whereby when unauthorized force is applied to said first end, said rotary bolt is urged to laterally shift against its bias into said secured position wherein said engaging surface engages said safety notch, further precluding rotation of said rotary bolt out of said protracted position.

5. The electro-mechanical rotary lock of claim 4, wherein:

said housing further comprises a plurality of second openings, said second openings being engaged by a plurality of electrical connectors;

whereby electrical signals associated with said coded sequence are transferred by known electrical means into said housing via said electrical connectors.

6. The electro-mechanical rotary lock of claim 5, wherein:

said housing further comprises a plurality of holes and a plurality of metallic balls, each of said balls being permanently inserted into a respective one of said holes, said plurality of holes being in a line traversing the exterior of said housing corresponding to the internal location of said post, reinforcing said location;

whereby said post is protected from unauthorized penetration of said housing.

7. An electro-mechanical rotary lock having:

a milled housing, said housing having a first machined level, a second machined level, a third machined level, a square first opening with a first and a second edge and a plurality of second openings, said first machined level having an arcuate first recess with a first and second end, and a circular bore, said second machined level having a generally rectangular second recess with opposed flange portions, and a plurality of mounting screw holes, said third machined level also having a plurality of mounting screw holes, said first and second edges having internally angled wall portions;

a generally D-shaped rotary bolt, having a center orifice and an off-center orifice;

a generally rectangular bolt plate sized to communicate with said first opening, having first and second sides with externally angled wall portions, and a bolt channel;

a cylindrical solenoid, having a body and an armature portion, said body having a circumferential groove;

a top plate, having a protruding edge, a corresponding bore and a plurality of mounting holes;

a coiled spring, having a loop end and a flat end;

a pivot pin, sized to communicate with said circular bore, said center orifice and said corresponding bore;

a spring pin, having a knob end and sized to communicate with said off-center orifice;

a plurality of electrical connectors, each of said connectors being engagable by a respective one of said second openings;

a circuit board which attaches to said second machined surface, said circuit board being attachable to said solenoid by known electrical means, and to said electrical connectors by known electrical means; and a top cover which attaches to said third machined surface of said housing, enclosing said housing.

8. The method of assembly of the rotary lock of claim 7, including the steps of:

inserting said spring pin into said off-center orifice with said knob end facing downward;

attaching said loop end of said spring to said knob end and inserting said flat end of said spring into said first end of said arcuate recess;

positioning said rotary bolt on said first machined level of said housing with said center orifice corresponding to said circular bore and said spring lying within said arcuate recess;

inserting said pivot pin through said center orifice and said circular bore;

inserting said solenoid into said second recess with said opposed flange portions entering said circumferential groove;

slidably attaching said bolt plate to said first opening with said rotary bolt protruding through said bolt channel and said internally angled wall portions and said externally angled wall portions cooperating together to enclose said first opening;

inserting said top plate onto said second machined level of said housing with top of said pivot pin entering said corresponding bore and said protruding edge extending through said bolt passage alongside said rotary bolt such that presence of said protruding edge maintains an enclosing pressure on said bolt plate forcing said internally angled wall portions and said externally angled wall portions together, and fixing said top plate in place by the use of mounting screws which insert into said mounting holes of said second level;

attaching said circuit board onto said second machined level of said housing, said solenoid being electrically attached to said circuit board, said electrical connectors being attached to said second openings, said electrical connectors being electrically attached to said circuit board;

attaching said top cover to said third machined level of said housing and fixing said top cover in place by the use of mounting screws which insert into said mounting holes of said third level.

9. An electro-mechanical rotary lock, comprising:

a housing, a bolt plate and a cover associated with said housing, said housing having a first opening, said bolt plate engaging said first opening and providing a bolt passage;

a spring biased rotary bolt which is rotatable between a protracted and a retracted position relative said bolt plate, said rotary bolt being generally D-shaped and having a first and a second end;

a locking means for normally restricting rotation of said rotary bolt;

an electronic combination entry device for manual entry of a coded sequence and an associated electrically operated means for producing a code responsive signal to disengage said locking means; and an entry preclusion means for restricting rotation of said rotary bolt in response to unauthorized forcing of said rotary bolt, wherein:

said entry preclusion means comprises a safety notch, an engaging surface, a spring and an elongated bore, said safety notch being integral to the periphery of said rotary bolt between said first end and said second end and disposed relative to be engaged by said engaging surface, said bolt plate providing said engaging surface, said elongated bore extending through the center of said rotary bolt and enabling said rotary bolt to shift laterally between a normally operable position and a secured position with said spring normally biasing said rotary bolt into said operable position;

whereby when unauthorized force is applied to said first end, said rotary bolt is urged to laterally shift against its bias into said secured position wherein said engaging surface engages said safety notch, further precluding rotation of said rotary bolt out of said protracted position.

10. An electro-mechanical rotary lock, comprising:

a housing, a bolt plate and a cover associated with said housing, said housing having a first opening, said bolt plate engaging said first opening and providing a bolt passage;

a spring biased rotary bolt which is rotatable between a protracted and a retracted position relative said bolt plate, said rotary bolt being generally D-shaped and having a first and a second end; said first end normally protrudes through said bolt passage and has a cam surface;

a locking means for normally restricting rotation of said rotary bolt;

an electronic combination entry device for manual entry of a coded sequence and an associated electrically operated means for producing a code responsive signal to disengage said locking means; and an entry preclusion means for restricting rotation of said rotary bolt in response to unauthorized forcing of said rotary bolt, wherein:

said entry preclusion means comprises a safety notch, an engaging surface, and an elongated bore, said safety notch being integral to the periphery of said rotary bolt between said first end and said second end and disposed relative to be engaged by said engaging surface, said bolt plate providing said engaging surface, said elongated bore extending through the center of said rotary bolt and enabling said rotary bolt to shift laterally between a normally operable position and a secured position whereby when unauthorized force is applied to said first end, said rotary bolt is urged to laterally shift against its bias into said secured position wherein said engaging surface engages said safety notch, further precluding rotation of said rotary bolt out of said protracted position.

11. An electro-mechanical rotary lock, comprising:

a housing, a bolt plate and a cover associated with said housing, said housing having a first opening, said bolt plate engaging said first opening and providing a bolt passage;

a spring biased rotary bolt which is rotatable between a protracted and a retracted position relative said bolt plate, said rotary bolt being generally D-shaped and having a first and a second end;

a locking means for normally restricting rotation of said rotary bolt;

an electronic combination entry device for manual entry of a coded sequence and an associated electrically operated means for producing a code responsive signal to disengage said locking means; and an entry preclusion means for restricting rotation of said rotary bolt in response to unauthorized forcing of said rotary bolt, said entry preclusion means including means for mounting said rotary bolt for lateral shifting movement to a non-rotatable secured position on said unauthorized forcing of said rotary bolt.

12. An electro-mechanical rotary lock comprising:

a housing having an opening providing a bolt passage;

a spring-biased rotary bolt which is rotatable between a protracted and a retracted position relative said bolt passage, said rotary bolt extending outwardly relative said housing when in said protracted position;

a locking means for normally restricting rotation of said rotary bolt;

an electronic combination entry device for manual entry for a coded sequence and an associated electrically-operated means for producing a code responsive signal to disengage said locking means; and an entry preclusion means for restricting rotation of said rotary bolt in response to unauthorized forcing of said rotary bolt.

13. The electro-mechanical rotary lock of claim 12, wherein:

said rotary bolt has a rotation limit stop and an associated overhanging retainer lip; and said locking means further comprises a post normally positioned to engage said limit stop and block rotation of said rotary bolt, said post having a retainer flange whereby when said post engages said limit stop, said post flange is retained by said retainer lip.

14. The electro-mechanical rotary lock of claim 13, wherein:

said electrically operated means comprises a solenoid having a body and armature portion normally biased outwardly of said body, and a circuit board for generating a code responsive signal which retracts said armature; and said circuit board is internal to said housing, and said armature provides said post.

15. The electro-mechanical rotary lock of claim 14, wherein:

said entry preclusion means comprises a safety notch, an engaging surface, a leaf spring and an elongated bore, said safety notch being integral to the periphery of said rotary bolt and disposed relative to be engaged by said engaging surface, an edge of said bolt passage providing said engaging surface, said elongated bore extending through the center of said rotary bolt and enabling said rotary bolt to shift laterally between a normally operable position and a secured position with said leaf spring normally biasing said rotary bolt into said operable position, said rotary bolt further having a recessed slot and said leaf spring engaging said recessed slot such that a portion of said leaf spring protrudes into said elongated bore;

whereby unauthorized force is applied to said rotary bolt, said rotary bolt is laterally shifted against its bias into said secure position wherein said engaging surface engages said safety notch, further precluding rotation of said rotary bolt out of said protracted position.

* * * * *